US007934669B2

(12) United States Patent
Schürz et al.

(10) Patent No.: US 7,934,669 B2
(45) Date of Patent: May 3, 2011

(54) NOZZLE ASSEMBLY AND INJECTION VALVE

(75) Inventors: Willibald Schürz, Pielenhofen (DE); Martin Simmet, Bad Abbach (DE)

(73) Assignee: Continental Automotive GmbH, Hannover (DE)

( * ) Notice: Subject to any disclaimer, the term of this patent is extended or adjusted under 35 U.S.C. 154(b) by 619 days.

(21) Appl. No.: 11/569,106

(22) PCT Filed: May 2, 2005

(86) PCT No.: PCT/EP2005/051985

§ 371 (c)(1),
(2), (4) Date: Nov. 14, 2006

(87) PCT Pub. No.: WO2005/111407

PCT Pub. Date: Nov. 24, 2005

(65) Prior Publication Data

US 2007/0210189 A1 Sep. 13, 2007

(30) Foreign Application Priority Data

May 14, 2004 (DE) ..... 10 2004 024 119

(51) Int. Cl.

| | |
|---|---|
| ***F02M 61/20*** | (2006.01) |
| ***F02M 59/00*** | (2006.01) |
| ***F02M 61/00*** | (2006.01) |
| ***F02M 57/02*** | (2006.01) |

(52) U.S. Cl. ..... 239/533.9; 239/533.2; 239/102.2; 123/299; 123/446

(58) Field of Classification Search .. 239/533.1–533.12; 123/299, 446, 447, 467, 468

See application file for complete search history.

(56) References Cited

U.S. PATENT DOCUMENTS

| | | | | |
|---|---|---|---|---|
| 2,391,808 | A * | 12/1945 | Vincent | 239/533.8 |
| 2,559,364 | A * | 7/1951 | Mashinter | 239/90 |
| 2,753,217 | A | 7/1956 | Pecora, Jr. et al. | 299/107.6 |

(Continued)

FOREIGN PATENT DOCUMENTS

| | | |
|---|---|---|
| DE | 197 36 682 A1 | 2/1999 |

(Continued)

OTHER PUBLICATIONS

German Office Action for German Patent Application No. 10 2004 024 119.8 (3 pages). Mar. 7, 2005.

(Continued)

*Primary Examiner* — Dinh Q Nguyen
*Assistant Examiner* — Justin Jonaitis
(74) *Attorney, Agent, or Firm* — King & Spalding L.L.P.

(57) ABSTRACT

An injection valve has an injector housing (1) and an actuator and also a nozzle assembly. The nozzle assembly has a nozzle body (6) with a recess (8) into which a nozzle needle (10) is introduced and at one axial end of which an injection nozzle (12) is embodied. The recess (8) has, axially adjacent to the injection nozzle (12), a first guide region (14) for the nozzle needle (10). The recess (8) also has at least one cross-sectional extension which extends toward the other axial end. The recess (8) is embodied for the purpose of delivering fluid to the injection nozzle (12). A guide bushing (20) is introduced into the recess (8) in a subsection of the cross-sectional extension, the guide bushing (20) forming a second guide region (22) for the nozzle needle (10) and being embodied for conducting fuel radially outside of the second guide region (22).

20 Claims, 2 Drawing Sheets

U.S. PATENT DOCUMENTS

| | | | | |
|---|---|---|---|---|
| 4,785,156 | A * | 11/1988 | Benko et al. | 219/121.64 |
| 5,727,738 | A | 3/1998 | Hoffmann et al. | 239/533.4 |
| 6,145,761 | A | 11/2000 | Müller et al. | 239/533.12 |
| 6,155,499 | A | 12/2000 | Rembold et al. | 239/533.12 |
| 6,467,460 | B1 | 10/2002 | Stier | 123/498 |
| 6,499,471 | B2 * | 12/2002 | Shen et al. | 123/498 |
| 7,040,550 | B2 * | 5/2006 | Hohl et al. | 239/102.2 |
| 7,044,407 | B2 * | 5/2006 | Fischer et al. | 239/533.7 |
| 7,195,182 | B2 * | 3/2007 | Fischer et al. | 239/585.5 |
| 2003/0127615 | A1 | 7/2003 | Fischer et al. | |
| 2003/0150939 | A1 * | 8/2003 | Lorraine et al. | 239/533.2 |
| 2004/0004139 | A1 * | 1/2004 | Fischer et al. | 239/584 |

FOREIGN PATENT DOCUMENTS

| | | | |
|---|---|---|---|
| DE | 100 54 182 | A1 | 5/2002 |
| DE | 44 40 182 | C2 | 9/2003 |
| DE | 102 17 594 | A1 | 11/2003 |
| EP | 1 088 985 | A2 | 4/2001 |
| EP | 1 382 838 | A2 | 1/2004 |
| JP | 2002540342 | | 11/2002 |
| JP | 2004506840 | T | 3/2004 |
| JP | 2004511701 | T | 4/2004 |
| WO | WO0057050 | A1 | 9/2000 |
| WO | WO0214683 | A1 | 2/2002 |
| WO | WO0231851 | A1 | 4/2002 |

OTHER PUBLICATIONS

International Search Report and Written Opinion for International Application No. PCT/EP2005/051985 (9 pages). Aug. 18, 2005.

Japan Office Action, Japan application No. 2007-512179, 8 pages. Jul. 6, 2009.

* cited by examiner

NOZZLE ASSEMBLY AND INJECTION VALVE

CROSS-REFERENCE TO RELATED APPLICATIONS

This application is a U.S. national stage application of International Application No. PCT/EP2005/051985 filed May 2, 2005, which designates the United States of America, and claims priority to German application number DE 10 2004 024 119.8 filed May 14, 2004, the contents of which are hereby incorporated by reference in their entirety.

TECHNICAL FIELD

The invention relates to a nozzle assembly and an injection valve which comprises the nozzle body and is suitable for metering fuel into a combustion chamber of a cylinder of an internal combustion engine.

BACKGROUND

Increasingly stringent statutory provisions relating to the permissible pollutant emissions from internal combustion engines that are disposed in motor vehicles make it necessary to take a variety of measures by means of which the pollutant emissions are lowered. One starting point in this endeavor is to directly reduce the pollutant emissions generated by the internal combustion engine as a result of the combustion process of the air/fuel mixture. A requirement for this is that the fuel is metered very precisely. This is possible by means of an injection valve which can be very precisely controlled. An injection valve comprises a nozzle assembly having a nozzle body with a recess into which a nozzle needle is introduced. The nozzle needle is axially movable in the recess and in a closed position closes an injection nozzle and in other positions releases said injection nozzle, thereby enabling fuel to be metered. With known injection valves an actuator which acts on the nozzle needle is also provided.

SUMMARY

The object of the invention is to create a nozzle assembly and an injection valve which are simple and can be precisely controlled.

The object can be achieved by a nozzle assembly comprising a nozzle body with a recess into which a nozzle needle is introduced and at one axial end of which an injection nozzle is embodied which, axially adjacent to the injection nozzle, has a first guide region for the nozzle needle which has at least one cross-sectional extension which extends toward the other axial end of the recess, the recess being embodied for supplying fluid to the injection nozzle, and in a subsection of the cross-sectional extension a guide bushing is introduced into the recess, which guide bushing forms a second guide region for the nozzle needle and which is embodied for conducting fluid radially outside of the second guide region, a coupling element being provided which is secured on the nozzle needle by means of an interference fit assembly, to which an axial end of a bellows is coupled and to which a spring holder is coupled on which an axial end of a resetting spring is supported.

In an embodiment, the guide bushing can be secured in the recess by means of an interference fit assembly. In an embodiment, the spring holder can be embodied in a sleeve shape. In an embodiment, the bellows can be linked at its other axial end to a sleeve which is mounted onto the nozzle needle and is coupled radially externally in a sealing manner to a cover plate which has a recess which is penetrated by the nozzle needle. In an embodiment, the cover plate can be coupled to the nozzle body by means of a laser solder joint. An injection valve may comprise such a nozzle assembly, an injector housing and an actuator which acts on the nozzle needle.

BRIEF DESCRIPTION OF THE DRAWINGS

The invention is characterized by a nozzle assembly having a nozzle body with a recess into which a nozzle needle is introduced and at one axial end of which an injection nozzle is embodied which, axially adjacent to the injection nozzle, has a first guide region for the nozzle needle which has at least one cross-sectional extension which extends toward the other axial end. The recess is embodied for the purpose of delivering fluid to the injection nozzle. A guide bushing is introduced in a subsection of the cross-sectional extension of the recess, said guide bushing forming a second guide region for the nozzle needle and being embodied for conducting fuel radially outside of the second guide region. The invention is further characterized by an injection valve having an injector housing in which an actuator is disposed and having the nozzle assembly.

The guide bushing enables a reduction of the cross-sectional area of the nozzle needle to be dispensed with in the second guide region. As a result a very high degree of rigidity of the nozzle needle can easily be ensured. A high degree of rigidity of the nozzle needle allows a precise movement of the nozzle needle even if the available actuator stroke is small. By means of the at least one cross-sectional extension of the recess the volume available for the fluid to be metered in the recess upstream of the guide bushing is increased. In this way pressure pulsations of the fluid in the area of the recess which arise after the release of the injection nozzle or after the closing of the injection nozzle can be attenuated. This leads on the one hand to a more precise metering of fluid and on the other hand also increases the life of the nozzle body.

According to an advantageous embodiment of the invention the guide bushing is secured in the recess of the nozzle body by means of an interference fit assembly. This has the advantage that both the guide bushing and the nozzle body can be manufactured from a readily temperable material without taking into consideration suitable material properties for other joining techniques such as, for example, welding.

According to a further advantageous embodiment of the invention the nozzle assembly has a coupling element which is secured on the nozzle needle by means of an interference fit assembly. An axial end of a bellows is coupled to the coupling element. Also coupled to the coupling element is a spring holder on which an axial end of a resetting spring for the nozzle needle is supported. Thus, the nozzle needle can be manufactured from a readily temperable material without taking into consideration suitable material properties for other joining methods with the coupling element such as, for example, welding. Moreover, both the resetting spring and the bellows can be coupled to the nozzle needle by means of the coupling element.

In this connection it is particularly advantageous if the spring holder is embodied in a sleeve shape. In this way the bellows and the resetting spring can be arranged axially overlapping. This means a shorter axial length of the nozzle needle is necessary, which results in a higher degree of rigidity of the nozzle needle. In addition a better transmission of power from the actuator via the nozzle needle is also possible, since forces acting radially in the nozzle spring can be canceled out by the sleeve-shaped spring holder and consequently are transmitted only to a small extent to the nozzle needle.

According to a further advantageous embodiment of the invention the bellows is coupled at its other axial end to a sleeve which is mounted onto the nozzle needle and is radially coupled externally in a sealing manner to a cover plate which has a recess through which the nozzle needle penetrates. In this way the area which adjoins the cover plate on its side which faces away from the guide bushing can be reliably sealed off against the fluid contained in the recess of the nozzle body.

It is also advantageous if the cover plate is coupled to the nozzle body by means of a laser solder joint. In this way only a very locally limited and, compared to welding, very small increase in heat is necessary when producing the join between the cover plate and the nozzle body. By this means it can easily be ensured that the stiffness of the resetting spring, for example, does not change during this joining operation.

Figure 1:
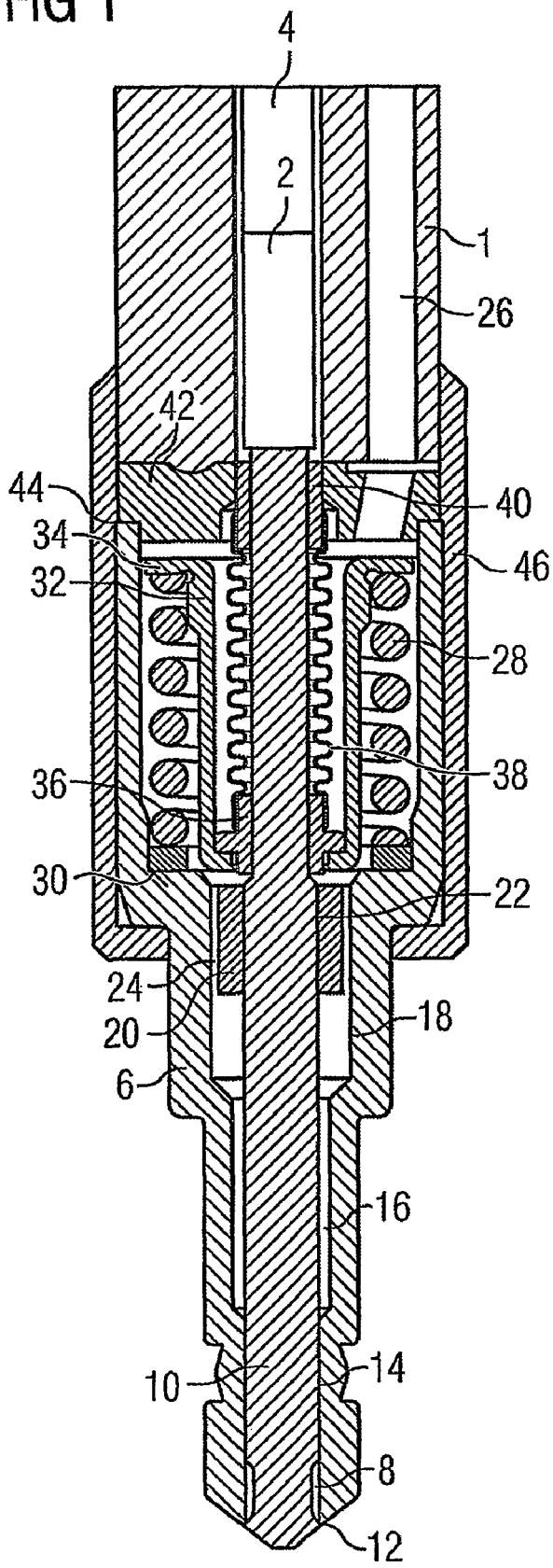

Exemplary embodiments of the invention are explained in more detail below by way of example with reference to the schematic drawings, in which:

FIG. 1 shows a section through an injection valve having a nozzle body and

Figure 2:
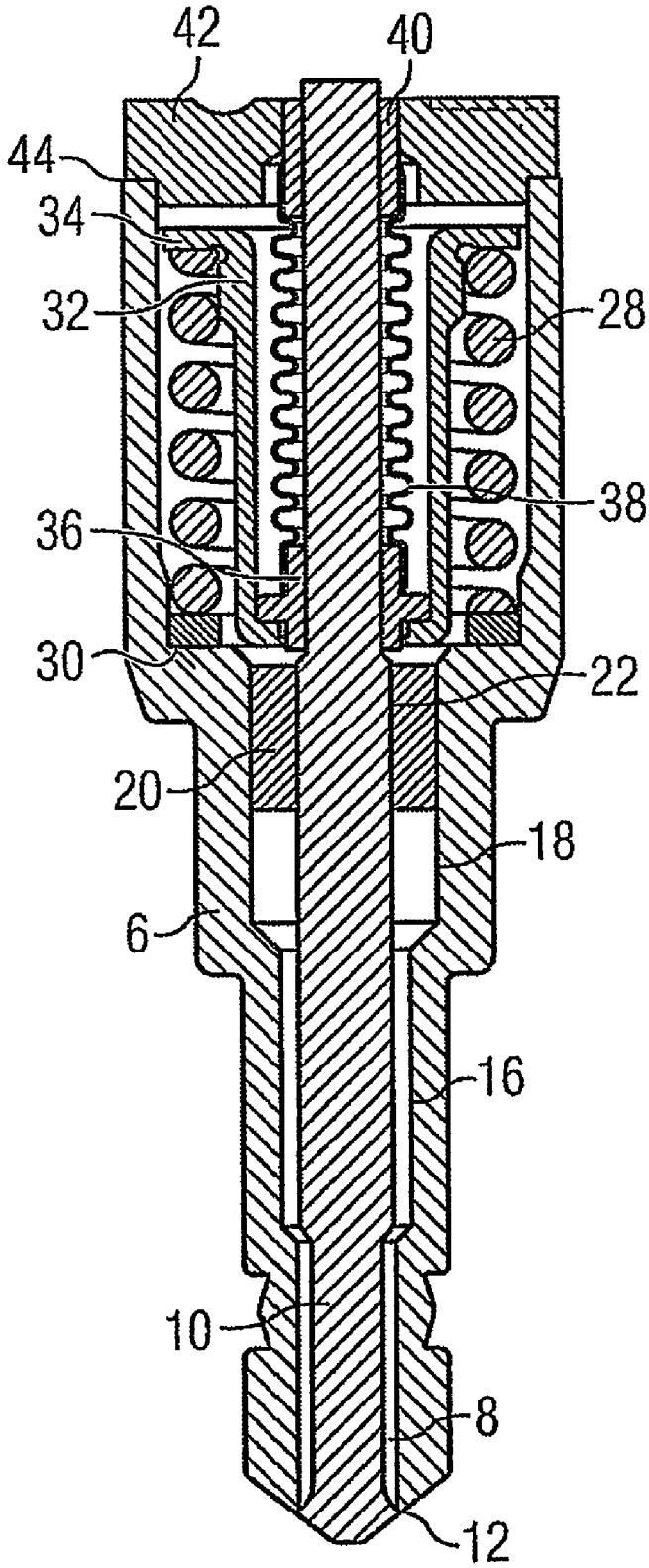

FIG. 2 shows a further section through the nozzle body according to FIG. 1.

Elements of identical construction or function are identified by the same reference symbols.

DETAILED DESCRIPTION

An injection valve, often also referred to as an injector (FIG. 1), has an injector housing 1 in which an actuator embodied as a piezoactuator 2 is disposed. A compensating element 4, which is preferably a hydraulic compensating element, is preferably also disposed in the injector housing 1 and thus balances out different coefficients of thermal expansion of the piezoactuator 2 and the injector housing 1.

The injection valve also comprises a nozzle body 6 with a recess 8 into which a nozzle needle 10 is introduced. An injection nozzle 12 is embodied at an axial end of the recess 8. The nozzle needle 10 is axially movable in the recess 8. In its closed position, which is shown in FIG. 1, it prevents a flow of fuel through the injection nozzle 12. A suitable axial expansion of the piezoactuator 2 leads to a movement of the nozzle needle 10 out of its closed position and consequently to a releasing of the fuel flow through the injection nozzle 12.

A first guide region 14 is embodied at the wall of the recess 8 in axial proximity to the injection nozzle 12. Adjoining the first guide region 14 the recess 8 has a first extension 16 of its cross-section at a corresponding axial distance, then also a second extension 18 of its cross-section. It can also have additional extensions of its cross-section. The recess 8 can thus be produced by simple drilling with drills of different diameter.

A guide bushing 20 is introduced into the recess 8 in the area of the second extension 18 of the cross-section. The guide bushing 20 has a second guide region 22 for the nozzle needle 10. It is preferably mated to the nozzle body 6 by means of an interference fit. It is also embodied for conducting fuel which can be routed through to the recess 8 via a high-pressure hole 26. Toward that end the guide bushing 20 preferably has at its radial circumference subsections which are radially set back compared to the radius of the recess 8 in the area of the second extension 18 of the cross-section. This can be easily achieved by means of one or more planar surfaces. This then has as a consequence that in a subsection of the circumference of the guide bushing 20 a gap 24 is formed between it and the nozzle body. In one or more other subsections of the circumference of the guide bushing 20 the latter then abuts the nozzle body by means of the interference fit. This is illustrated with the aid of the section shown in FIG. 2. Alternatively the fuel can also be routed in the area of the guide bushing 20 through the recess 8 by means of another suitable embodiment of the guide bushing 20. Toward that end, one or more axial holes can be embodied, in the guide bushing, for example, radially outside of the second guide region 22.

The conducting of the fuel through the recess 8 in the area in which the guide bushing 20 is disposed is therefore effected by means of an appropriate embodiment of the guide bushing and does not require the cross-sectional area of the nozzle needle 10 to be reduced in this area in order to conduct the fuel. This has the advantage that the rigidity of the nozzle needle is higher than if such a reduction of the cross-sectional area cannot be dispensed with. Both the nozzle body 6 and the guide bushing 20 are preferably embodied from a readily temperable material, preferably a steel with a high carbon content. In this way a high degree of hardness that is favorable for the guide regions 14, 22 can easily be realized.

Also disposed in the nozzle body 6 is a resetting spring 28 which is supported at its one free axial end on a shoulder 30 of the nozzle body 1. If appropriate, an adjusting disk can also be inserted in addition between the shoulder 30 and the one free axial end of the resetting spring 28.

At its other axial end the resetting spring 28 is supported on a spring holder 32 and, more specifically, on a collar 34 of the spring holder 32. The spring holder 32 is mechanically coupled to the nozzle needle 10 by means of a coupling element 36 and pretensions said nozzle needle 10 into its closed position. Preferably, though not necessarily, the spring holder 32 has a sleeve-shaped area which extends in the axial direction coaxially to the nozzle needle 10. The spring holder 32 is particularly easily coupled to the coupling element 36 by means of a positive fit. However, it can also be coupled to the coupling element 36 by means of, for example, welding or soldering.

The coupling element 36 is coupled to the nozzle needle 10 by means of an interference fit. For the purpose of mounting the coupling element 36 the nozzle needle is preferably coated with a sliding agent which includes Teflon during the manufacture of the injection valve and then the coupling element 36 is pressed onto the nozzle needle 10 by suitable mounting with a corresponding force. The interference fit between the coupling element 36 and the nozzle needle 10 has the advantage that an otherwise necessary welding to achieve the mechanical coupling of the coupling element 36 to the nozzle needle 10 can be dispensed with and consequently the nozzle needle can be manufactured from a very readily temperable material which generally is unsuitable for welding.

A bellows 38 is also linked to the coupling element 36 at its one free axial end. The bellows 38 is preferably made of metal. The bellows 38 is preferably welded to the coupling element 36. At its other axial end the bellows 38 is coupled to a sleeve 40 and moreover also preferably by means of a welded joint.

The sleeve 40 is also joined at its external circumference in a sealing manner to a cover plate 42. The cover plate 42 is joined in an area 44 in a sealing manner to the nozzle body 6. In this way it can easily be ensured that the fuel contained in the recess 8 does not reach the piezoactuator 2.

The cover plate 42 is preferably joined to the nozzle body 6 in the area 44 by means of a laser solder joint. A solder containing silver is preferably used as the solder. Silver-bearing solder is characterized by a relatively low melting temperature and consequently the required thermal energy during the soldering process is relatively small. Furthermore, soldering by means of a laser is characterized in that the thermal energy can be supplied locally very precisely and therefore can also be supplied in a correspondingly locally limited manner, which results in the adjacent components being heated up only to an insignificant extent during the soldering. This is of advantage in particular in connection with the resetting spring 28, since its spring stiffness can change permanently if said resetting spring 28 is heated to a correspondingly high temperature.

The nozzle body 6, the nozzle needle 10, the guide bushing 20, the resetting spring 28, the spring holder 32, the coupling element 36, the bellows 38, the sleeve 40 and the cover plate 42 form a nozzle assembly.

The nozzle assembly is coupled to the injector housing 1 by means of a nozzle retaining nut 46. As a result of the embodiment of the nozzle retaining nut 46, the nozzle body 6, the cover plate 42 and the injector housing 1, as shown in FIG. 1, it is ensured that no powerful tensile forces have to be transmitted in the area 44. The preferred solder joint between the cover plate 42 and the nozzle body 6 must therefore essentially be able to fulfill merely a sealing function.

In an alternative embodiment, however, the nozzle body 6 can also be welded to the cover plate 42. The embodiment of the coupling element 36, the spring holder 32 can also be realized independently of the guide bushing 20.

What is claimed is:

1. A nozzle assembly comprising a nozzle body with a recess into which a nozzle needle is introduced and at one axial end of which an injection nozzle is embodied which, axially adjacent to the injection nozzle, has a first guide region for the nozzle needle which has at least one cross-sectional extension which extends toward the other axial end of the recess, the recess being embodied for supplying fluid to the injection nozzle, and in a subsection of the cross-sectional extension a guide bushing is introduced into the recess, which guide bushing forms a second guide region for the nozzle needle and which is embodied for conducting fluid radially outside of the second guide region, the nozzle assembly further comprising a coupling element which is secured on the nozzle needle, wherein an axial end of a bellows is directly connected to the coupling element and a sleeve shaped spring holder is rigidly connected to the coupling element, wherein an axial end of a resetting spring is supported by the spring holder, wherein the spring holder is designed to axially cover the bellows, and wherein the coupling element and spring holder are rigidly secured to the nozzle needle such that the coupling element and spring holder are carried by the nozzle needle during axial movement of the nozzle needle relative to the nozzle body.

2. The nozzle assembly according to claim 1, wherein the guide bushing is secured in the recess by means of an interference fit assembly.

3. The nozzle assembly according to claim 1, wherein the coupling element is secured on the nozzle needle by means of an interference fit assembly.

4. The nozzle assembly according to claim 1, wherein the bellows is linked at its other axial end to a sleeve which is mounted onto the nozzle needle and is coupled radially in a sealing manner to a cover plate which has a recess which is penetrated by the nozzle needle.

5. The nozzle assembly according to claim 4, wherein the cover plate is coupled to the nozzle body by means of a laser solder joint.

6. An injection valve comprising a nozzle assembly as claimed in claim 1, an injector housing and an actuator which acts on the nozzle needle.

7. A nozzle assembly comprising a nozzle body with a recess, a nozzle needle arranged in said recess and comprising an injection nozzle, a first guide region axially adjacent to the injection nozzle for the nozzle needle which has at least one cross-sectional extension which extends toward the other axial end of the recess, a guide bushing spaced apart from said first guide region, which guide bushing forms a second guide region for the nozzle needle, and a coupling element which is secured on the nozzle needle, wherein an axial end of a bellows is fixed to the coupling element, wherein a spring holder is rigidly fixed to the coupling element, wherein an axial end of a resetting spring is supported by the spring holder, wherein the spring holder axially covers at least a portion of the bellows, and wherein the coupling element and spring holder are rigidly secured to the nozzle needle such that the coupling element and spring holder are carried by the nozzle needle during axial movement of the nozzle needle relative to the nozzle body.

8. The nozzle assembly according to claim 7, wherein the second guide region is embodied for conducting fluid radially outside of the second guide region.

9. The nozzle assembly according to claim 7, wherein the guide bushing is secured in the recess by means of an interference fit assembly.

10. The nozzle assembly according to claim 7, wherein the spring holder is embodied in a sleeve shape.

11. The nozzle assembly according to claim 7, wherein the bellows is linked at its other axial end to a sleeve which is mounted onto the nozzle needle and is coupled radially in a sealing manner to a cover plate which has a recess which is penetrated by the nozzle needle.

12. The nozzle assembly according to claim 11, wherein the cover plate is coupled to the nozzle body by means of a laser solder joint.

13. An injection valve comprising a nozzle assembly as claimed in claim 7, an injector housing and an actuator which acts on the nozzle needle.

14. A nozzle assembly comprising a nozzle body with a recess, a nozzle needle arranged in said recess and comprising an injection nozzle, a first and second guide region axially spaced apart within said recess for guiding the nozzle needle, and a coupling element secured on the nozzle needle, a bellows extending from the coupling element; and a spring holder rigidly coupled to and extending from the coupling element and supporting an axial end of a resetting spring, wherein the spring holder axially covers at least a portion of the bellows, and wherein the coupling element and spring holder are rigidly secured to the nozzle needle such that the coupling element and spring holder are carried by the nozzle needle during axial movement of the nozzle needle relative to the nozzle body.

15. The nozzle assembly according to claim 14, wherein the second guide region is embodied for conducting fluid radially outside of the second guide region.

16. The nozzle assembly according to claim 14, wherein the spring holder is embodied in a sleeve shape.

17. The nozzle assembly according to claim 14, wherein the bellows is linked at its other axial end to a sleeve which is mounted onto the nozzle needle and is coupled radially in a sealing manner to a cover plate which has a recess which is penetrated by the nozzle needle.

18. The nozzle assembly according to claim 14, wherein the cover plate is coupled to the nozzle body by means of a laser solder joint.

19. The nozzle assembly according to claim 7, wherein the coupling element is secured on the nozzle needle by means of an interference fit assembly.

20. The nozzle assembly according to claim 14, wherein the coupling element is secured on the nozzle needle by means of an interference fit assembly.

* * * * *